US005595645A

United States Patent [19]

Barr

[11] Patent Number: 5,595,645

[45] Date of Patent: Jan. 21, 1997

[54] ELECTROLYTIC OXIDATION PROCESS

[75] Inventor: Neal Barr, Clayfield, Australia

[73] Assignee: Spunboa Pty Ltd, Queensland, Australia

[21] Appl. No.: 393,011

[22] PCT Filed: Aug. 26, 1993

[86] PCT No.: PCT/AU93/00436

§ 371 Date: Feb. 27, 1995

§ 102(e) Date: Feb. 27, 1995

[87] PCT Pub. No.: WO94/04720

PCT Pub. Date: Mar. 3, 1994

[30] Foreign Application Priority Data

Aug. 26, 1992 [AU] Australia ..... PL4324

[51] Int. Cl.[6] ..... C25D 7/00

[52] U.S. Cl. ..... 205/771; 205/509

[58] Field of Search ..... 204/96, DIG. 13, 204/130, 149, 305, 509, 771

[56] References Cited

U.S. PATENT DOCUMENTS

| | | | |
|---|---|---|---|
| 2,200,987 | 5/1940 | Hubbell | 205/99 |
| 3,960,695 | 6/1976 | Roller | 204/227 |
| 4,148,700 | 4/1979 | Eddleman | 204/130 |

FOREIGN PATENT DOCUMENTS

| | | |
|---|---|---|
| 3630157 | 3/1988 | Germany . |
| 55-145189 | 11/1980 | Japan . |
| 903426 | 11/1958 | United Kingdom . |
| WO8809399 | 12/1988 | WIPO . |
| WO9214865 | 9/1992 | WIPO . |

*Primary Examiner*—Donald R. Valentine
*Assistant Examiner*—Brendan Mee
*Attorney, Agent, or Firm*—Fitzpatrick, Cella, Harper & Scinto

[57] ABSTRACT

A process for removing ferrous ions from a solution comprising the steps of: (a) introducing the solution into an electrolytic cell having an anode and a cathode, (b) electrolytically oxidizing ferrous ions in the presence of hydroxyl ions to produce ferric hydroxide, and (c) removing the solution from the cell, wherein liquid turbulence is induced at or in the proximity of, at least a portion of the surface of the anode whereby a mechanically stable, non-dendritic ferric hydroxide precipitate grows on or near the anode. Preferably, the ferrous ions are oxidized in the presence of chlorine. The chlorine may be electrolytically produced in the cell.

29 Claims, 4 Drawing Sheets

ELECTROLYTIC OXIDATION PROCESS

FIELD OF THE INVENTION

The present invention is concerned with the electrolytic oxidation of ferrous iron to ferric iron and, more particularly, with the electrolytic oxidation of ferrous iron in solution to cause precipitation of ferric hydroxide.

BACKGROUND ART

In particular, the invention has application in the hot dip galvanising industry which uses ammonium chloride and/or zinc ammonium chloride solutions as pre-flux baths for the preparation of the surface of the steel for galvanising. Prior to the fluxing process, the steel is subject to a pickling process and the steel being carried from the pickling bath to the pre-flux bath will often carry some pickle solution with it. This leads to contamination of the pre-flux bath with pickle liquor which causes the accumulation of iron in the pre-flux bath in the form of dissolved ferrous ion. In order to maintain the quality of the pre-flux solution the iron must be periodically or continuously removed. The standard industry method is treatment with hydrogen peroxide to oxidise the ferrous ion no the ferric ion together with pH control by ammonia addition to precipitate the iron as ferric hydroxide. This is usually done on a batch basis and the ferric hydroxide precipitate removed as a sludge after one or two days settling and subsequent decantation of the clear liquor.

This method suffers from considerable waste of solution due to entrainment in the sludge. The pre-flux bath is also subject to variation in composition and quality of the solution with time between treatments and there is a considerable bath down time for each precipitation treatment. Furthermore, the messy sludge that is produced must be dealt with and there is difficulty in disposing of the impure iron hydroxide as well as the inherent dangers o f handling a dangerous chemical such as a strong hydrogen peroxide solution. One means of reducing the contamination of the pre-flux bath used to date has been to provide a rinse bath between the pickling and pre-flux dips. This is only a partial solution, however as the disposal problems associated with the contaminated rinse water must be dealt with and any rise in iron level in the pre-flux solution cannot be directly remedied.

In German Patent No. 3630157 it is proposed to treat contaminated pre-flux liquor electrolytically in a separate vessel. The treatment comprises applying a direct current to a simple electrolytic cell having a pair of plate electrodes, the cathode being made of iron or aluminium and the anode made of graphite, positioned in an open bath of electrolyte (in this case the contaminated pre-flux liquor) to precipitate ferric hydroxide. The efficiency of a cell of this kind is quite low, particularly when the current density exceeds that required for iron oxidation at the anode. In operation, the precipitate is continuously removed from the cell by a liquid current flow which sweeps the precipitated mud into a filter device to prevent deposits of ferrous mud forming on the bottom of the flux vessel. The patent is primarily concerned with the provision of the filter device. The flow through the cell need only be sufficient to cause the ferric mud to become entrapped in the filter device and therefore iron transport to the anode is low. The German Patent requires an alternating current to be superimposed on the direct current to prevent dendritic deposits on the electrodes.

The present invention provides a process in which the turbulence is induced at, or in the proximity of, the anode to enhance mass transport to the anode with the result that a mechanically stable non-dendritic ferric hydroxide precipitate is grown on or near the anode. The precipitate on the anode may be progressively scoured from the anode and carried from the cell as a granular precipitate having good settling properties.

DISCLOSURE OF INVENTION

In one broad aspect the invention resides in a process for removing ferrous ions from a solution comprising the steps of:

(a) introducing the solution into an electrolytic cell having an anode and a cathode, (b) electrolytically oxidising ferrous ions in the presence of hydroxyl ions to produce ferric hydroxide, and (c) removing the solution from the cell, wherein liquid turbulence is induced at, or in the proximity of, at least a portion of the surface of the anode whereby a mechanically stable, non-dendritic ferric hydroxide precipitate grows on or near the anode.

Preferably, the liquid turbulence is induced by the physical construction of the cell and/or the flow characteristics of the solution moving through the cell.

More preferably, the liquid turbulence is induced by contact with the surface of the anode or the surface of a precipitate on the anode as the solution flows over it at high velocity.

Advantageously, the solution moves through the cell with a plug flow or a cyclonic flow.

More preferably the pH is maintained in the range of 3.5 to 5.5.

In a particularly preferred embodiment of the invention the ferrous ions are oxidised in the presence of chlorine.

Advantageously, the chlorine is electrolytically produced in situ.

Preferably, the cell is a closed electrolytic cell including an inlet for introducing the solution and an outlet for removing the solution.

In one embodiment of the invention, the cell is square or rectangular in cross-section, the anode constituting one side wall and the cathode the opposite side wall of the cell, the inlet being located at one end of the cell and the outlet at the other.

Alternatively, the cell comprises a tubular anode and a rod cathode disposed coaxially within the tubular anode.

Typically the outer surface of the tubular anode forms an external wall of the cell, the inlet is located in an inlet cap at one end of the tubular anode and the outlet is located in an outlet cap at the other end of the tubular anode.

In one form of the invention the inlet, the outlet and the cathode are axially aligned whereby plug flow of the solution is induced.

Alternatively, the inlet and the outlet are located substantially normally of the axis of the cell whereby cyclonic flow of the solution is induced.

Preferably, the flow rate of the solution is in the range of 0.2 to 5 m/s, more preferably, 0.2 to 2 m/s.

In one form of the invention the cathode is separated from the anode by a barrier to minimise deposition of metal on the cathode.

Advantageously, the barrier is a cation exchange membrane.

Alternatively, turbulence is induced at, or in the proximity of, at least a portion of the surface of the cathode to facilitate reaction on the cathode. An AC overcurrent superimposed over the DC is not necessary to achieve solid non-dendritic zinc plating.

Typically, the reaction on the cathode is reduction of zinc with the result that zinc plates on the cathode.

Preferably, solution removed from the cell is recycled through the cell.

Typically the solution introduced into the cell is a contaminated ammonium chloride or zinc ammonium chloride solution, however, the system is suitable for removing iron from any iron (II) bearing solution, in particular, solutions containing a dissolved iron contaminant. These solutions may be solutions of ammonium salts, particularly the sulfates and chlorides, such as the zinc ammonium chloride solutions that are used in pre-flux baths. A galvanising pre-flux bath can be maintained in good operating condition, with low dissolved iron content, on a continuous basis without the need for a rinse bath intermediate to the pickle and pre-flux dipping processes when the present invention is used. However, a static rinse bath to reduce the size of the treatment plant may be economically advantageous.

BRIEF DESCRIPTION OF THE DRAWINGS

A preferred embodiment of the invention will now be described and readily understood with reference to the accompanying drawings in which:

Referring now to FIG. 1, it may be seen than the electrolytic cell for treating iron-contaminated pre-flux solution consists of a tubular anode 11 encircling a rod cathode 12 with the concentric relationship of the anode 11 and the cathode 12 being maintained by end caps 13, 14. The anode 11 is a titanium tube coated on its inner surface with a metal oxide, the coating being of the type used for chlorine production. The cathode 12 is a rod made of any suitable material such as mild steel, stainless steel, nickel, zinc, carbon or zinc alloy. The anode 11 forms the external wall of the cell. At the bottom of the cell the anode 11 sits on a rib 13 extending inwardly from bottom end cap 14 which supports the anode in upright disposition. A compression ring 16 positioned around the anode 11 and fixed to end cap 14 by bolts 17 secures the anode in position when tightened. An O-ring 15 seals the cell. At the top of the cell the top end cap 18 has a rib 19 which sits on the top end of anode 11. The top end cap 18 is secured to the anode by compression ring 19 which encircles the anode. Bolt 21 fixes the compression ring 23 to the top end cap 18. An O-ring 26 provides a seal between the end cap 18 and anode 11. The cathode 12 has a nib 22 which is fixed in an aperture in a compression ring 24. The cathode 12 also has projection 25 (which can be an integral part of the cathode or a separate piece made of plastic attached to the cathode) extending around its circumference which is sandwiched between compression ring 24 and the top surface of top end cap 18. Bolt 21 extends through compression ring 24 and screws it to top end cap 18, a seal being provided by O-ring 27. The cathode 12 is thus suspended from the top end cap 18 into the region encircled by anode 11. The cathode 12 extends past the anode 11 at top and bottom being suspended from the top end cap 18 and resting in an indentation 28 in bottom end cap 14. A screw thread on the internal surface of the end caps could engage a complementary thread on the ends of the anode as an alternative means of securing them to the anode. The cell can include a flow settling portion adjacent the inlet if desired.

Figure 2:
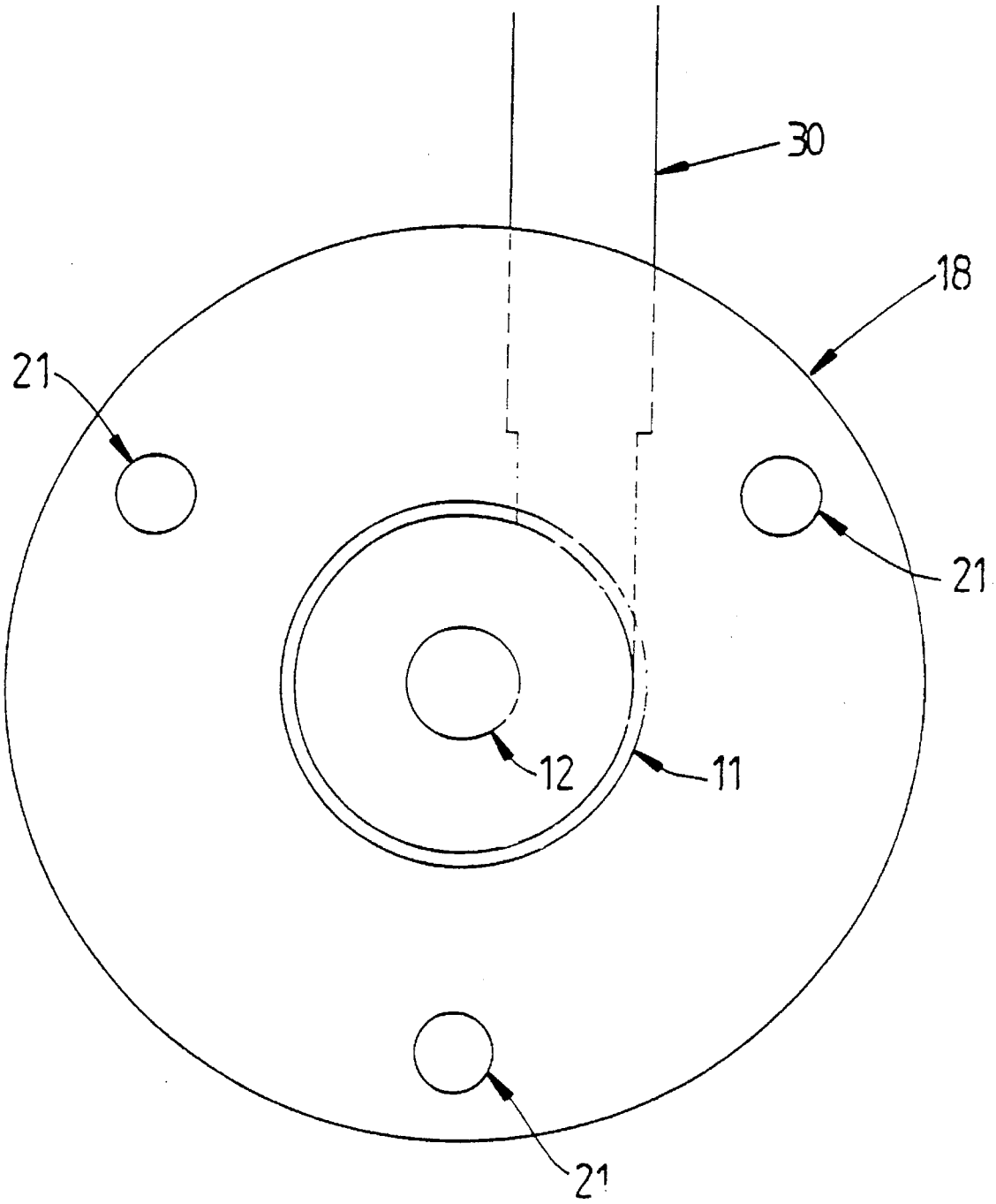
FIG. 2 shows a cross-section through the end-cap at the outlet showing the inlet/outlet orientation.

inlet 29 at the bottom of the cell penetrates bottom end cap 14 and enters the cell tangential to the circular cross-section of the cell. Outlet 30 at the top of the cell likewise penetrates the top end cap 18 in a direction tangential to the circular cross-section of the cell This is best seen in FIG. 2. It will be appreciated by those skilled in the art, that entering the cell through the tangential inlet 29 imparts a tangential velocity on the liquid and sets up a swirling flow up through the cell to the outlet 30 which is positioned so that the fluid sweeps out through the outlet with minimal interruption to the cyclonic flow. The inlet and the outlet are thus matched. The cyclonic flow in the cell tends to centrifuge solids towards the anode.

The velocity of the fluid through the cell is sufficient to induce turbulence on the anode. Generally liquid enters the cell through inlet 29 at a velocity of about 2.0 m/s. Thus, the liquid moves over both the anode 11 and the cathode 12 with a velocity high enough that turbulent flow is induced in the vicinity of both the anode and the cathode. It is believed that the turbulence adjacent the anode increases mass transport to the anode which aids migration of ferrous ions to the anode while turbulence adjacent the cathode ensures good zinc plating. Good zinc plating is favourable commercially as the cell does not need to be stopped frequently to clean off the dendritic deposits of zinc which otherwise tend to flake off or bridge the electrodes, and may cause short circuits.

The pH of the liquid in the cell is preferably maintained in the range of 3.5 to 5.5. At a pH below 3.5 the precipitation of ferric hydroxide is not favoured. Above a pH of 5.5 chlorine generation on the anode is not favoured. It is believed that the presence of chlorine is advantageous because chemical oxidation of ferrous ions to ferric ions also takes place in the solution adjacent the anode and this allows the ferric hydroxide precipitate to be grown progressively. As the layer of ferric hydroxide builds up efficiency at the anode does not decrease apparently because this reaction continues on the surface of the precipitate on the anode and on particles that are scoured from the anode. When the pH is maintained between 3.5 and 5.5 the process typically works at near 100% current efficiency for iron oxidation as the major secondary reaction on the anode is chlorine generation.

The precipitate formed is mechanically stable and non-dendritic. There is, however, continual abrasion of the precipitate from the anode so that compact dense particles of ferric hydroxide are swept from the cell. In previously known processes a ferric hydroxide mud or sludge has to be removed from the cell. The liquid passing out of the outlet 30 may be recycled through the cell to further enhance growth of the precipitate. Alternatively a plurality of cells can be arranged in series, in parallel series or in parallel, although a parallel flow arrangement is preferred especially for high current densities.

In the event that it is desired to avoid metal plating on the cathode a cell divider or membrane can be placed around the cathode. Preferably the membrane is a cation exchange membrane which will allow hydrogen ions to migrate to the cathode.

Figure 1:
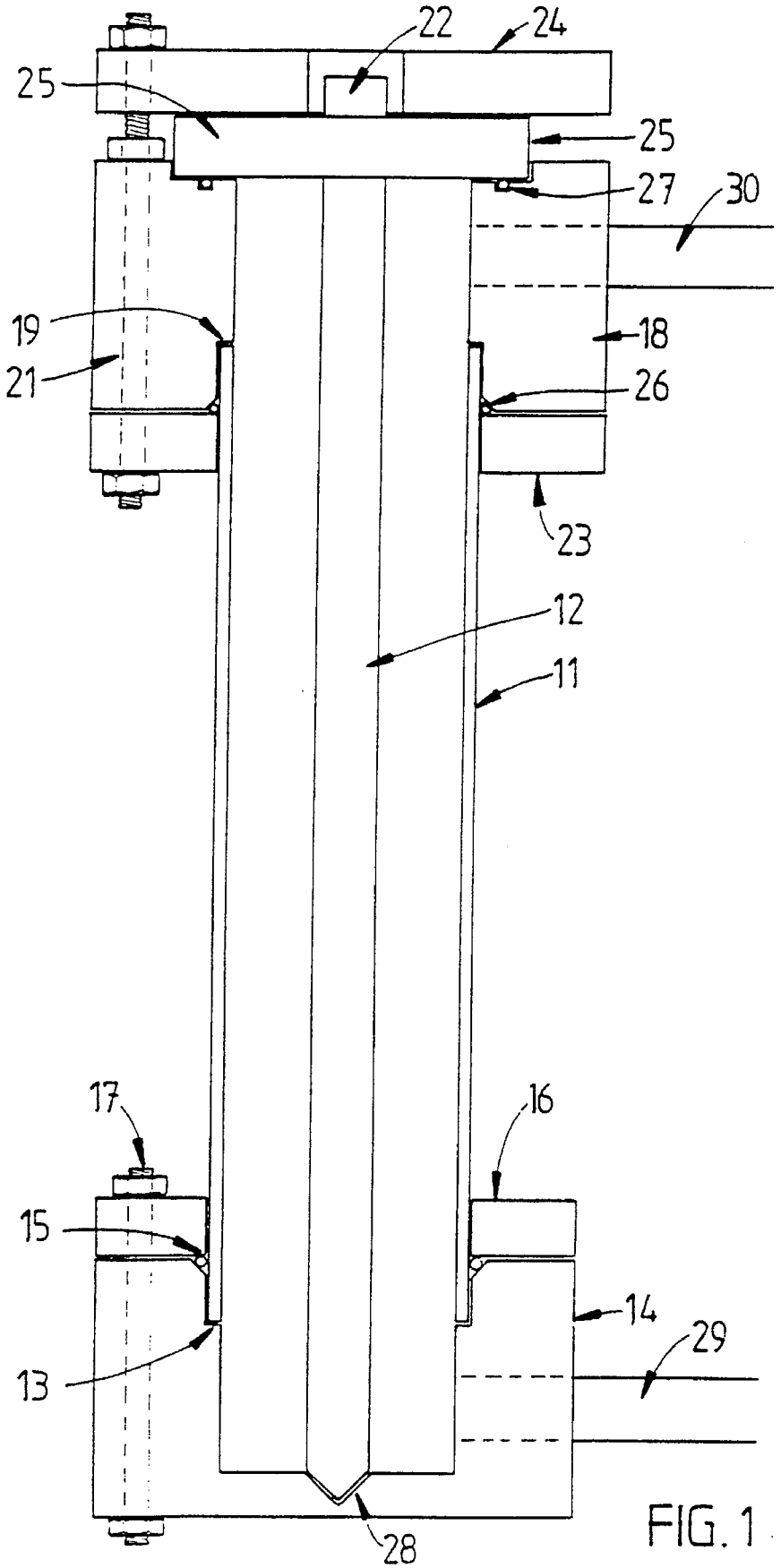
FIG. 1 illustrates a longitudinal section through an electrolytic cell in accordance with the present invention.
Figure 3:
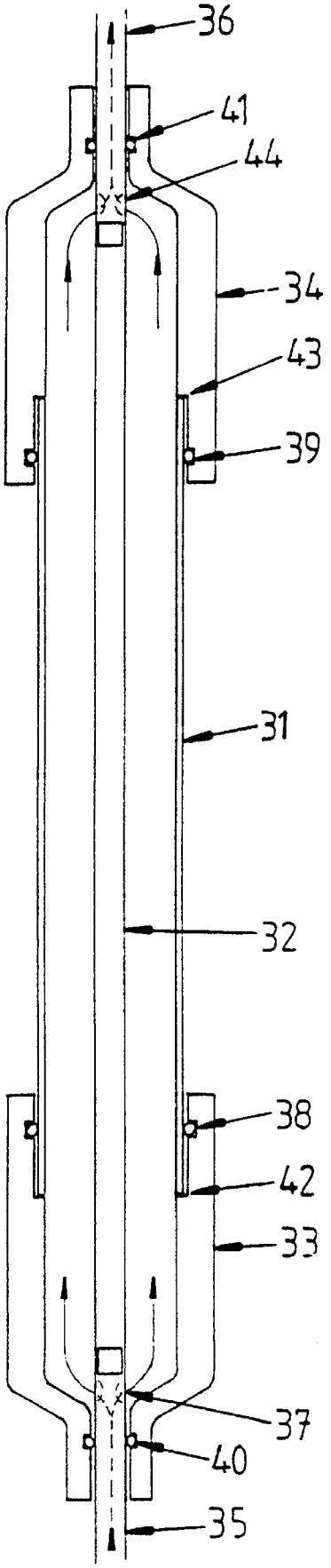
FIG. 3 is a similar view to FIG. 1 showing an alternative embodiment of the invention.

FIG. 3 shows a cell similar to that shown in FIG. 1 except the inlet to and the outlet from the cell are axial instead of tangential The cell comprises an anode 31 and cathode 32 fixed in concentric disposition. Bottom end cap 33 and top end cap 34 are each screwed onto the anode 31 which has a thread complementary to that on the end caps. As in FIG. 1, the anode 31 sits on rib 42 extending inwardly from end cap 40 and rib 43 on end cap 34 sits on the top of the anode 31. The cell is sealed by O-rings 38, 39, 40, 41. Contaminated pre-flux liquid enters the cell through axial inlet 35 which includes outlet 37 into the cell. The liquid flows in a plug flow at about 2.0 m/s up through the cell and exits the cell through outlet 36 via orifice 44.

Figure 4:
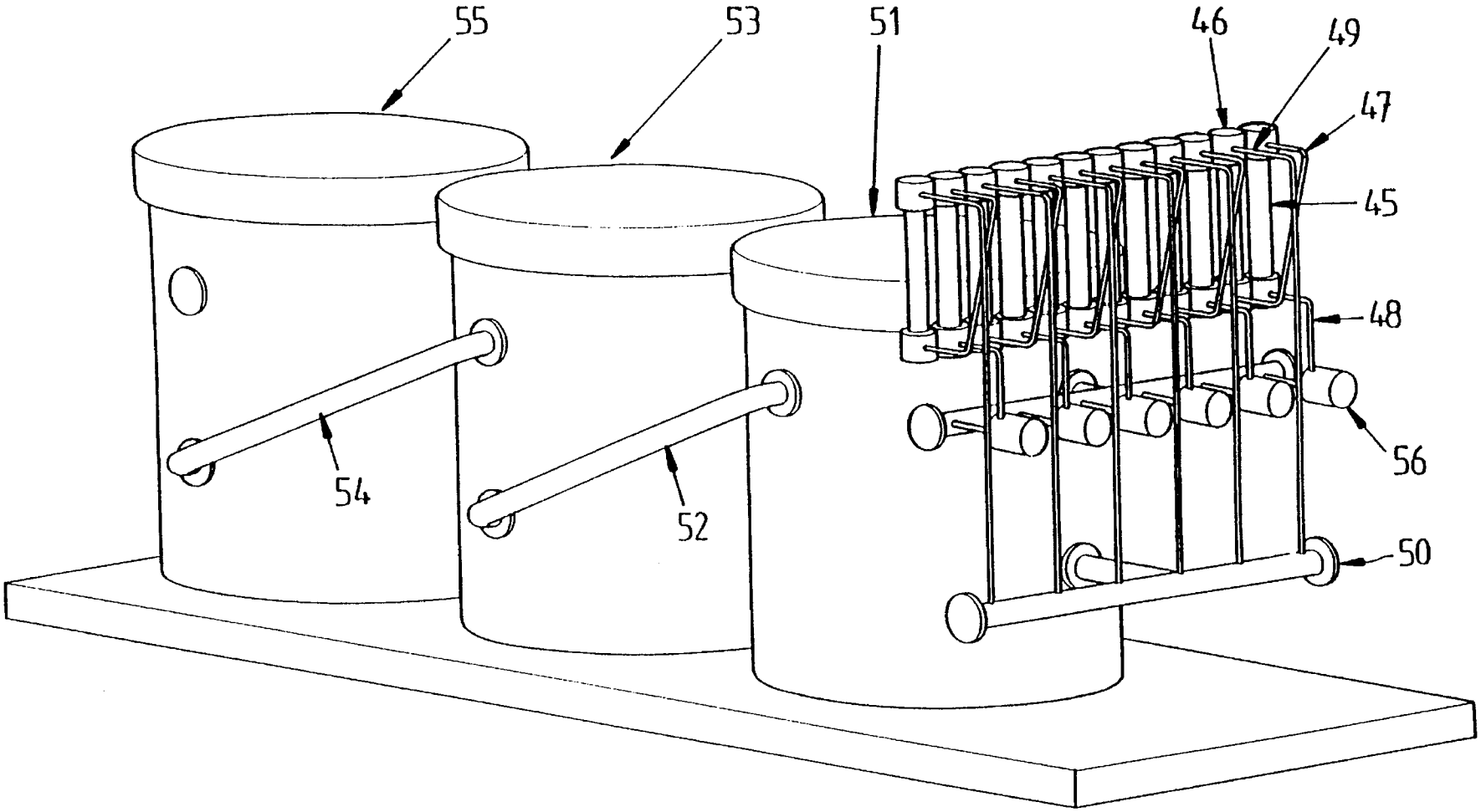
FIG. 4 shows a perspective view of a reactor system in accordance with the present invention.

FIG. 4 shows a reactor system in which either of the reactors described with reference to FIGS. 1 and 2 of FIG. 3 could be employed but is illustrated with each cell being of the type shown in FIGS. 1 and 2. The reactor system comprises twelve electrolytic cells, adjacent cells such as cells 45 and 46 having the outlet 47 from cell 45 constituting the inlet to cell 46 so as to link the cells in hydraulic series. Thus, there are six parallel pairs of cells, each pair of cells having an inlet from manifold 56 such as inlet 48 to cell 45 and an outlet to manifold 50 such as outlet 49 from cell 46. Manifold 56 is connected to an outlet from near the top of the recirculation tank 51 and manifold 50 is connected to an inlet near the bottom of recirculation tank 51. The recirculation tank 51 is fed from the pro-flux bath. Thus, a mixture of fresh and recycled liquid is directed to the electrolytic cells from near the top of the recirculation tank 51 and treated liquid re-enters the tank 51 at a level below that of the outlet manifold. Chemical reactions, for example continued chemical oxidation on the surface of the ferric hydroxide particles can continue in the outlet 49 and the tank 51.

As liquid level in the recirculation tank 51 rises, the liquid may pass into either manifold 56 or the overflow pipe 52 which diverts the liquid into sedimentation tank 53. On average the liquid entering pipe 52 will be significantly reduced in dissolved iron content and contain ferric hydroxide precipitate as a result of the electrolytic treatment of the liquid. The liquid is not necessarily totally treated so a small amount of dissolved iron may remain. In sedimentation tank 53 most of the ferric hydroxide settles out and the solution is passed through pipe 54 into sedimentation tank 55 where the remainder of the ferric hydroxide settles out. Relatively pure pro-flux solution can then be passed back to the pre-flux bath.

The pre-flux solution is typically ammonium chloride or zinc ammonium chloride but contains iron as a contaminant. When an electric potential is applied to the electrolytic cell zinc ions (and hydrogen ions) migrate towards the cathode and chloride ions (and hydroxyl ions) migrate towards the anode. The iron ions move under forced convection to the anode as a result of the turbulent flow in that region of the cell.

The zinc plates on the cathode, although this can be prevented by placing a barrier around the cathode, and chlorine gas is generated at the anode if the current density on the anode exceeds that necessary to oxidize the iron (II) to iron (III). When iron (III) is produced it reacts quickly with hydroxyl ions in solution to precipitate iron (III) hydroxide. The precipitate can grow on the electrode but there is continual abrasion of the precipitate by the turbulent flow of the electrolyte. Small particles of iron (III) hydroxide loose in the electrolyte and iron (III) hydroxide on the anode tend to grow as they come into contact with chlorine and then with iron (II) in solution whereupon oxidation of the iron (II) takes place and further precipitation of iron (III) hydroxide occurs. Thus, a precipitate is formed which settles rapidly when scoured off the anode and so is easily removed from the pre-flux solution.

MODES FOR CARRYING OUT THE INVENTION

EXAMPLE 1

5 liters of pre-flux containing 3.7 grams per liter of dissolved iron was maintained at a pH of 5.0 during treatment. The electrolytic cell was composed of a coated titanium anode tube 500 mm long and 24 mm internal diameter, with a central nickel cathode rod 15 mm in diameter. The solution was pumped through the cell at a rate of 8 l/min and a current of 12 amps was passed through the cell for 2,700 seconds over which time the dissolved iron decreased linearly to zero. The produced iron hydroxide precipitate had a settling rate of $8.1\times10^{-4}$ meters per second.

EXAMPLE 2

An electrolytic unit comprising 4 electrolytic cells with a total anode area of 0.3 $m^2$ and using mild steel cathode rods 15 mm in diameter, total working area 0.1 $m^2$, operating at up to 150 amps, was able to maintain a 30,000 liter pre-flux bath between 0.6 and 1.3 g/l without the use of a rinse bath. The maintained level varied with the rate of work throughput which varied from 0 to 80 tonnes of dipped steelwork per day. The feed rate from the pre-flux varied between 2 and 10 l/min and the recirculation rate was 20 l/min in each of the four cells. Cathodes were changed and stripped twice daily. Oxidative performance over a period of one month showed in the order of 100% electrolytic efficiency based upon oxidation of iron. Sedimentation was performed on a continuous basis using a sedimentation unit of 2 $m^3$ volumetric capacity.

EXAMPLE 3

A reactor comprising six electrolytic cells (the cells being arranged as three parallel arrangements of two cells in each in series) operating at an average current of 8 amps per cell was used to treat a pre-flux bath in a galvanising plant for the period of a year. A static rinse bath was employed between the pickle bath and the pre-flux bath in the galvanising plant which was an 11,000 tonne per annum dipping plant. The concentration of iron in the pre-flux solution was maintained at between 1 and 1.8 grams per liter over this period with a zero liquid discharge from the rinse and pre-flux baths, except for withdrawal of rinse solution for acid pickle make-up within the plant. The reactor was run as described above and in this case the pre-flux solution was pumped through each cell at a rate of 20 liters per minute. Zinc loadings of 10 kg to 30 kg per square meter of plate zinc on the cathode were routinely achieved. The zinc was a recycle quality (99% or better).

INDUSTRIAL APPLICABILITY

The process is suitable for removing iron from any ferrous ion bearing solution and has particular application in removing dissolved iron from a pre-flux solution used in galvanising.

I claim:

1. A process for removing ferrous ions from an ammonium chloride or zinc ammonium chloride solution contaminated with ferrous ions, the process comprising the steps of:

(a) introducing the solution into an electrolytic cell having an anode and a cathode at a flow rate greater than 0.2, (b) electrolytically oxidizing ferrous ions where hydroxyl ions are present to produce ferric hydroxide, and (c) removing the solution from the cell, wherein liquid turbulence is induced at, or in the proximity of, at least a portion of the surface of the anode where a mechanically stable, non-dendritic ferric hydroxide precipitate grows on or near the anode.

2. A process as claimed in claim 1 wherein the liquid turbulence is induced by the physical construction of the cell.

3. A process as claimed in claim 2 wherein the liquid turbulence is induced by contact with the surface of the anode or the surface of a precipitate on the anode as the solution flows over it at a flow rate greater than 0.2 m/s.

4. A process as claimed in claim 3 wherein the solution moves through the cell with a plug flow.

5. A process as claimed in claim 3 wherein the solution moves through the cell with a cyclonic flow.

6. A process as claimed in claim 1, further comprising the step of maintaining pH in the solution in the range of 3.5 to 5.5.

7. A process as claimed in claim 1, further comprising the step of oxidizing the ferrous ions in the presence of chlorine.

8. A process as claimed in claim 7 wherein the chlorine is electrolytically produced in situ.

9. A process as claimed in claim 1, further comprising the step of separating the cathode from the anode by a barrier to minimize deposition of metal on the cathode.

10. A process as claimed in claim 9, wherein the barrier is a cation exchange membrane.

11. A process as claimed in claim 1, wherein turbulence is induced at, or in the proximity of, at least a portion of the surface of the cathode to facilitate reaction on the cathode.

12. A process as claimed in claim 11, wherein the reaction on the cathode is reduction of zinc with the result that zinc plates on the cathode.

13. A process as claimed in claim 1, wherein solution removed from the cell is recycled through the cell.

14. A process as claimed in claim 1 wherein the solution is a pre-flux bath solution for preparing the surface of steel for hot dip galvanizing.

15. A process for removing ferrous ions from a solution comprising the steps of:

providing a closed electrolytic cell including an inlet for introducing the solution and an outlet for removing the solution, the electrolytic cell having an anode and a cathode;

introducing the solution into the electrolytic cell at a flow rate greater than 0.2 m/s;

electrolytically oxidizing ferrous ions where hydroxyl ion are present to produce ferric hydroxide; and removing the solution from the cell, wherein liquid turbulence is induced at, or in the proximity of, at least a portion of the surface of the anode where a mechanically stable, non-dendritic ferric hydroxide precipitate grows on or near the anode.

16. A process as claimed in claim 15 wherein the cell is square or rectangular in cross-section, the anode forms one side wall of the cell and the cathode forms an opposite side wall of the cell, the inlet being located at one end of the cell and the outlet at the other end of the cell.

17. A process as claimed in claim 15 wherein the cell comprises a tubular anode and a rod cathode disposed coaxially within the tubular anode.

18. A process as claimed in claim 17 wherein the outer surface of the tubular anode forms an external wall of the cell, the inlet is located in an inlet cap at one end of the tubular anode, and the outlet is located in an outlet cap at the other end of the tubular anode.

19. A process as claimed in claim 18 wherein the inlet, the outlet and the cathode are axially aligned to induce plug flow of the solution.

20. A process as claimed in claim 18 wherein the inlet and the outlet are located substantially normally of the axis of the cell to induce spiral flow of the solution.

21. A process as claimed in claim 17 wherein the flow rate of the solution is in the range of 0.2 to 5 m/s.

22. A process as claimed in claim 14, wherein the solution introduced into the cell is a contaminated ammonium chloride or zinc ammonium chloride solution.

23. A process as claimed in claim 21, wherein the flow rate of the solution is in the range of 0.2 to 2 m/s.

24. A process as claimed in claim 15, further comprising the step of separating the cathode from the anode by a barrier to minimize deposition of metal on the cathode.

25. A process as claimed in claim 22 wherein the barrier is a cation exchange membrane.

26. A process as claimed in claim 15 wherein turbulence is induced at, or in the proximity of, at least a portion of the surface of the cathode to facilitate a reduction reaction on the cathode.

27. A process as claimed in claim 26 wherein the reaction on the cathode is reduction of zinc with the result that zinc plates on the cathode.

28. A process as claimed in claim 15 wherein solution removed from the cell is recycled through the cell.

29. A process as claimed in claim 15 wherein the solution introduced into the cell is a contaminated ammonium chloride or zinc ammonium chloride solution.

* * * * *

UNITED STATES PATENT AND TRADEMARK OFFICE

CERTIFICATE OF CORRECTION

PATENT NO. : 5,595,645 Page 1 of 2

DATED : January 21, 1997

INVENTOR(S) : NEAL BARR

It is certified that error appears in the above-indentified patent and that said Letters Patent is hereby corrected as shown below:

COLUMN 1

Line 39, "o f" should read --of--.
Line 43, "however" should read --however,--.

COLUMN 4

Line 7, "inlet 29" should read --Inlet 29--.

COLUMN 5

Line 13, "2 of" should read --2 or--.
Line 24, "pro-flux" should read --pre-flux--.
Line 44, "pro-flux" should read --pre-flux--.
Line 47, "cell" should read --cell,--.

UNITED STATES PATENT AND TRADEMARK OFFICE

CERTIFICATE OF CORRECTION

PATENT NO. : 5,595,645

DATED : January 21, 1997

INVENTOR(S) : NEAL BARR

It is certified that error appears in the above-indentified patent and that said Letters Patent is hereby corrected as shown below:

COLUMN 6

Line 64, "0.2," should read --0.2 m/s,--.

COLUMN 7

Line 48, "ion" should read --ions--.

COLUMN 8

Line 27, "claim 14," should read --claim 21,--.
Line 35, "claim 22" should read --claim 24--.

Signed and Sealed this

Eighteenth Day of November 1997

*Attest:*

*Attesting Officer*

BRUCE LEHMAN

*Commissioner of Patents and Trademarks*